US011505299B1

(12) United States Patent
Broughton et al.

(10) Patent No.: US 11,505,299 B1
(45) Date of Patent: Nov. 22, 2022

(54) MARINE ENGINE ASSEMBLY

(71) Applicant: BRP US INC., Sturtevant, WI (US)

(72) Inventors: George Broughton, Wadsworth, IL (US); James Macier, Beach Park, IL (US)

(73) Assignee: BRP US INC., Sturtevant, WI (US)

( * ) Notice: Subject to any disclaimer, the term of this patent is extended or adjusted under 35 U.S.C. 154(b) by 295 days.

(21) Appl. No.: 16/725,433

(22) Filed: Dec. 23, 2019

Related U.S. Application Data

(60) Provisional application No. 62/786,857, filed on Dec. 31, 2018.

(51) Int. Cl.
*B63H 21/38* (2006.01)
*B63H 23/34* (2006.01)

(52) U.S. Cl.
CPC ..... *B63H 21/38* (2013.01); *B63H 23/34* (2013.01)

(58) Field of Classification Search
CPC ..... B63H 21/38; B63H 23/34
See application file for complete search history.

(56) References Cited

U.S. PATENT DOCUMENTS 2,207,372 A 7/1940 Clarke
2,216,496 A 10/1940 Mackay
3,164,122 A 1/1965 Morris
3,269,351 A 8/1966 Shimanckas
3,452,704 A 6/1969 Cothron
3,911,853 A 10/1975 Strang
4,178,873 A 12/1979 Bankstahl
4,354,847 A 10/1982 Blanchard
4,504,237 A 3/1985 Blanchard
4,559,018 A 12/1985 Harada et al.
4,666,410 A 5/1987 Anselm
4,726,799 A 2/1988 Harada et al.
4,773,215 A * 9/1988 Winberg ..... F01N 13/12 440/89 R
5,176,551 A * 1/1993 Blanchard ..... F02M 35/10013 440/88 R
5,344,350 A * 9/1994 Hatch ..... B63H 20/32 123/195 P
5,472,361 A * 12/1995 Fujimoto ..... B63H 20/24 440/89 R
5,562,511 A 10/1996 Blanchard et al.
(Continued)

*Primary Examiner* — S. Joseph Morano
*Assistant Examiner* — Jovon E Hayes
(74) *Attorney, Agent, or Firm* — BCF LLP

(57) ABSTRACT

A watercraft and a marine engine assembly for mounting to a watercraft are disclosed. The marine engine assembly includes an engine unit including: an engine unit housing being sealed such that water in which the engine unit housing is immersed is impeded from entering the engine unit housing; an engine in the housing; and an air intake assembly in the engine unit housing which forms a conduit between an exterior of the engine unit housing and the engine, the air intake assembly defining an inlet fluidly communicating with exterior air, the engine unit housing defining at least one aperture aligned with the inlet, the air intake assembly defining at least one outlet fluidly connected with the engine intake, the air intake assembly being sealed such that surrounding fluids within the engine unit housing are impeded from entering the air intake assembly; and a propulsion device operatively connected to the engine.

20 Claims, 13 Drawing Sheets

(56) References Cited

U.S. PATENT DOCUMENTS

| | | | | |
|---|---|---|---|---|
| 5,996,734 | A | 12/1999 | Blanchard et al. | |
| 5,997,371 | A * | 12/1999 | Oishi | F01N 13/12 440/88 L |
| 6,082,343 | A * | 7/2000 | Oishi | F01M 13/022 123/572 |
| 6,346,018 | B1 * | 2/2002 | Watanabe | F02F 7/0068 440/88 L |
| 6,516,768 | B1 * | 2/2003 | Watanabe | F02M 35/10085 123/573 |
| 6,626,154 | B1 * | 9/2003 | Kanno | F02B 75/20 123/480 |
| 7,510,451 | B2 * | 3/2009 | Inaba | F02B 61/045 440/88 C |
| D714,345 | S | 9/2014 | Petit et al. | |
| 8,826,845 | B2 | 9/2014 | Mochizuki et al. | |
| 8,858,282 | B2 | 10/2014 | Lonnborg et al. | |
| 9,051,041 | B2 | 6/2015 | Litjens et al. | |
| 9,126,664 | B1 | 9/2015 | Denson et al. | |
| 9,216,795 | B2 | 12/2015 | McGill, Jr. | |
| 9,254,904 | B2 | 2/2016 | Minoura | |
| 9,296,456 | B2 | 3/2016 | Mochizuki et al. | |
| 9,664,100 | B2 | 5/2017 | Shomura et al. | |
| 10,850,820 | B1 | 12/2020 | Minogue | |
| 10,927,745 | B1 * | 2/2021 | Langenfeld | F02F 7/007 |
| 10,981,636 | B1 * | 4/2021 | Langenfeld | F02B 29/0406 |
| 2002/0108587 | A1 * | 8/2002 | Nagashima | F02F 1/10 123/41.72 |
| 2004/0107925 | A1 * | 6/2004 | Katayama | F02D 31/001 123/90.15 |
| 2012/0115376 | A1 | 5/2012 | Daikoku et al. | |
| 2013/0280970 | A1 * | 10/2013 | Clarkson | B63H 20/245 440/88 A |

* cited by examiner

MARINE ENGINE ASSEMBLY

CROSS-REFERENCE

The present application claims priority from U.S. Provisional Application No. 62/786,857, filed Dec. 31, 2018, the entirety of which is incorporated herein by reference.

TECHNICAL FIELD

The present technology relates to marine engines and more specifically air intake assemblies for marine engine assemblies.

BACKGROUND

A typical marine outboard engine assembly is formed from an engine unit with an internal combustion engine, a lower unit with a propeller, and a midsection connecting the engine to the propeller. The midsection also has an exhaust channel to bring exhaust from the engine to be expelled out through the lower unit.

The engine assembly is generally connected to its corresponding watercraft by a transom or mounting bracket, typically connected to the midsection, below the engine unit. The bracket connects to a rear portion of the watercraft, such that the engine unit and part of the midsection is well above the water. In some cases, however, it could be preferable to have a marine engine which is disposed lower relative to the watercraft to allow more useable room in the watercraft for example.

However, by positioning the outboard engine lower, a portion of the engine unit will likely be in the water at least some of the time during use, risking water entry into the engine unit housing. As engines generally take in air from within the engine unit housing for combustion, water infiltrating the housing could enter into the engine.

Therefore, there is a desire for a marine engine assembly without at least some of the inconveniences described above.

SUMMARY

It is an object of the present technology to ameliorate at least some of the inconveniences present in the prior art.

According to one aspect of the present technology, there is provided an air intake assembly for a marine engine assembly. The marine engine assembly is structured to be connected under a deck of a watercraft. As such the typical midsection has been removed in order to both lower the engine unit with respect to its corresponding watercraft while maintaining the propeller at its correct water depth when in use. The lower unit is thus connected directly to the engine unit. The engine unit, at least some of the time when in use, is then partially submerged in water, due also to the transom bracket being connected higher on the engine unit than would typically be the case for an outboard engine. When the engine unit is partially submerged in water, the housing surrounding the engine is sealed to prevent entry of water into the engine unit and air cannot freely circulate into the engine unit to provide air for combustion in the engine. The air intake assembly thus acts as a conduit to deliver air to the engine. The air intake assembly is also sealed to impede any air, water, gas that may happen to be inside the engine unit from being brought into to the engine via the air intake assembly.

According to one aspect of the present technology, there is provided a marine engine assembly for mounting to a watercraft. The marine engine assembly includes an engine unit including: an engine unit housing being sealed such that water in which the engine unit housing is immersed is impeded from entering the engine unit housing; an engine disposed in the engine unit housing; and an air intake assembly disposed in the engine unit housing, the air intake assembly forming a conduit between an exterior of the engine unit housing and the engine, the air intake assembly defining an inlet fluidly communicating with air exterior to the engine unit housing, the engine unit housing defining at least one aperture aligned with the inlet, the air intake assembly defining at least one outlet fluidly connected with at least one cylinder intake of the engine, the air intake assembly being sealed such that fluids surrounding the air intake assembly within the engine unit housing are impeded from entering the air intake assembly; and a propulsion device operatively connected to the engine.

In some embodiments, the air intake assembly includes at least one throttle body disposed between the inlet and the at least one outlet.

In some embodiments, the marine engine assembly further includes a lower unit abutting and connected to the engine unit, the lower unit including: a lower unit housing fastened to the engine unit housing; a gear case disposed in the lower unit housing, the gear case being operatively connected to the engine; and the propulsion device connected to the gear case.

In some embodiments, the air intake assembly includes: a first conduit portion defining a first conduit inlet and a first conduit outlet; a second conduit portion defining: a second conduit inlet fluidly connected to the first conduit outlet; and at least one second conduit outlet defined by the second conduit portion, the at least one second conduit outlet being fluidly connected to the at last one cylinder intake of the engine; and a throttle body fluidly connected between the first conduit outlet and the second conduit inlet.

In some embodiments, the first conduit inlet is the inlet of the air intake assembly.

In some embodiments, the air intake assembly further includes a hose extending and connected between the first conduit outlet and the throttle body.

In some embodiments, the first conduit portion is a silencer for reducing noise of operation.

In some embodiments, the second conduit portion is a plenum.

In some embodiments, the first conduit outlet, the throttle body, and the second conduit inlet are disposed in an upper portion of the air intake assembly.

In some embodiments, the at least one cylinder intake is three vertically spaced cylinder intakes; the at least one the second conduit outlet is three vertically spaced second conduit outlets; and each of the three second conduit outlets is fluidly connected to a corresponding one of the three cylinder intakes.

In some embodiments, the air intake assembly includes a silencer; and the silencer includes: an inlet portion defining the inlet, a resonator portion extending from the inlet portion, the resonator portion being adapted for reducing noise of operation, and a outlet portion extending from the resonator portion.

In some embodiments, the resonator portion has a length extending from the inlet portion to the outlet portion and a width extending perpendicular to the length, the length being greater than the width.

In some embodiments, the inlet portion has a first length and a first width; the length of the resonator portion is a second length and the width of the resonator is a second width; the outlet portion has a third length and a third width; the second length is greater than the first length and the third length; and the second width is less than the first width and the third width.

In some embodiments, a height of the resonator portion is greater than the second length and the second width.

In some embodiments, the air intake assembly extends along one lateral side of the engine unit housing; and the air intake assembly is disposed between the engine and the one lateral side of the engine unit housing.

In some embodiments, the marine engine assembly further includes an exhaust conduit fluidly connected to the engine, the exhaust conduit being disposed in the engine unit housing; and the air intake assembly and the exhaust conduit are disposed on opposite sides of the engine.

In some embodiments, the marine engine assembly further includes an external conduit fluidly connected to the air intake assembly, at least a majority of the external conduit being disposed outside of the engine unit housing, at least a portion of the external conduit being aligned with the at least one aperture of the engine unit housing, an outlet defined by the external conduit being fluidly connected to the inlet of the air intake assembly.

In some embodiments, the external conduit defines a plurality of inlets, the external conduit being adapted for connected to a plurality of hoses disposed in the watercraft.

In some embodiments, the marine engine assembly further includes a transom bracket connected to the engine unit housing.

In some embodiments, a driveshaft operatively connects the engine to the propulsion device. The transom bracket defines a tilt-trim axis. A center of mass of the engine is disposed below the tilt-trim axis at least when the driveshaft is vertically oriented.

According to another aspect of the present technology, there is provided a watercraft including a watercraft body; and a marine engine assembly mounted to the watercraft body, the marine engine assembly including a transom bracket connected to the watercraft body, the transom bracket defining a tilt-trim axis; and an engine unit. The engine unit includes: an engine unit housing connected to the transom bracket; an engine disposed in the engine unit housing; and an air intake assembly disposed in the engine unit housing, the air intake assembly forming a conduit between an exterior of the engine unit housing and the engine, the air intake assembly defining an inlet fluidly communicating with air exterior to the engine unit housing, the engine unit housing defining at least one aperture aligned with the inlet, the air intake assembly defining an outlet fluidly connected with at least one cylinder intake of the engine, the air intake assembly being sealed such that fluids surrounding the air intake assembly within the engine unit housing are impeded from entering the air intake assembly. The marine engine assembly also includes a driveshaft operatively connected to the engine; and a propulsion device operatively connected to the driveshaft. A center of mass of the engine being disposed below the tilt-trim axis at least when the driveshaft is vertically oriented.

For purposes of this application, terms related to spatial orientation such as forward, rearward, upward, downward, left, and right, should be understood in a frame of reference of the marine engine assembly, as it would be mounted to a watercraft with its driveshaft vertically oriented. Terms related to spatial orientation when describing or referring to components or sub-assemblies of the engine assembly separately therefrom should be understood as they would be understood when these components or sub-assemblies are mounted in the marine engine assembly, unless specified otherwise in this application.

Explanations and/or definitions of terms provided in the present application take precedence over explanations and/or definitions of these terms that may be found in any documents incorporated herein by reference.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that the Figures are not necessarily drawn to scale.

DETAILED DESCRIPTION

The present technology is described with reference to its use in a marine outboard engine assembly that is used to propel a watercraft. It is contemplated that the present technology could have various uses, including in marine engines installed in watercraft.

Figure 1:
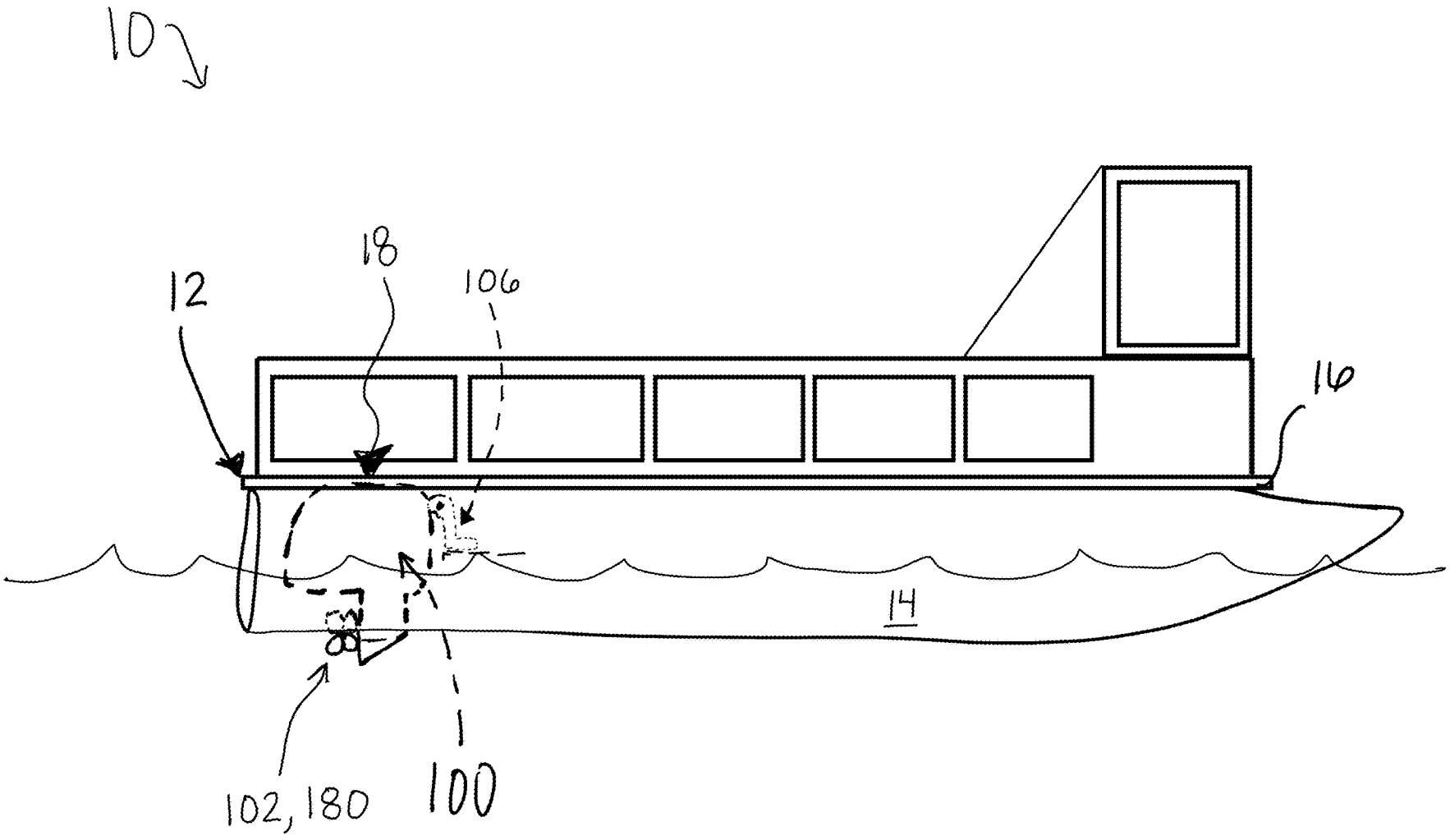
FIG. 1 is a right side elevation view of a watercraft according to the present technology.

In FIG. 1, a watercraft 10 according to the present technology is illustrated. The watercraft 10 is specifically a pontoon boat 10, but this is simply one non-limiting example of a watercraft according to the present technology. This particular embodiment of the boat 10 includes a watercraft body 12 formed generally from two pontoons 14 (only one being illustrated) and a platform 16.

The boat 10 also includes a marine engine assembly 100, also referred to herein as the assembly 100. The assembly 100 is pivotably and rotatably connected to the watercraft body 12 for providing propulsion via a propulsion device 102. The propulsion device 102 is specifically a propeller 102 in the present embodiment, but it is contemplated that the propulsion device 102 could be different in some embodiments.

The assembly 100 includes a transom bracket 106 which is fastened to the watercraft body 12. As is shown schematically, the transom bracket 106 is connected to a lower portion of the platform 16, such that the assembly 100 is generally disposed below a top surface 18, also called the deck 18, of the platform 16 laterally between the pontoons 14.

With additional reference to FIGS. 2 to 7, the marine engine assembly 100, shown separately from the watercraft 10, will now be described in more detail. The assembly 100 includes an engine unit 110, a lower unit 170, and the transom bracket 106.

The engine unit 110 includes an engine unit housing 112 for supporting and covering components disposed therein. The housing 112 is sealed such that water in which the engine unit housing 112 is immersed is impeded from entering the engine unit housing 112 during normal operating conditions, including when at rest, and components of the engine inside the housing 112 are water-proofed to the same degree as in a conventional outboard engine. Depending on the specific embodiment of the housing 112 and methods used to produce a generally water-tight seal, the housing 112 could be water-proof to varying degrees. It is contemplated that the housing 112 could receive different treatments to seal the housing 112 depending on the specific application for which the marine engine assembly 100 is going to be used. It is contemplated that the housing 112 could include a check valve or other waterproof pressure relief mechanism to equalize the pressure inside and outside the housing 112.

The engine unit 110 includes an internal combustion engine 120 disposed in the engine unit housing 112 for powering the assembly 100 and for driving the propeller 102. In the present embodiment, the internal combustion engine 120 is a three-cylinder, two-stroke, gasoline-powered, direct injected internal combustion engine. It is contemplated that the internal combustion engine 120 could be a four-stroke internal combustion engine. It is contemplated that the engine 120 could have more or less than three cylinders. In some embodiments, the internal combustion engine 120 could use a fuel other than gasoline, such as diesel.

Figure 3:
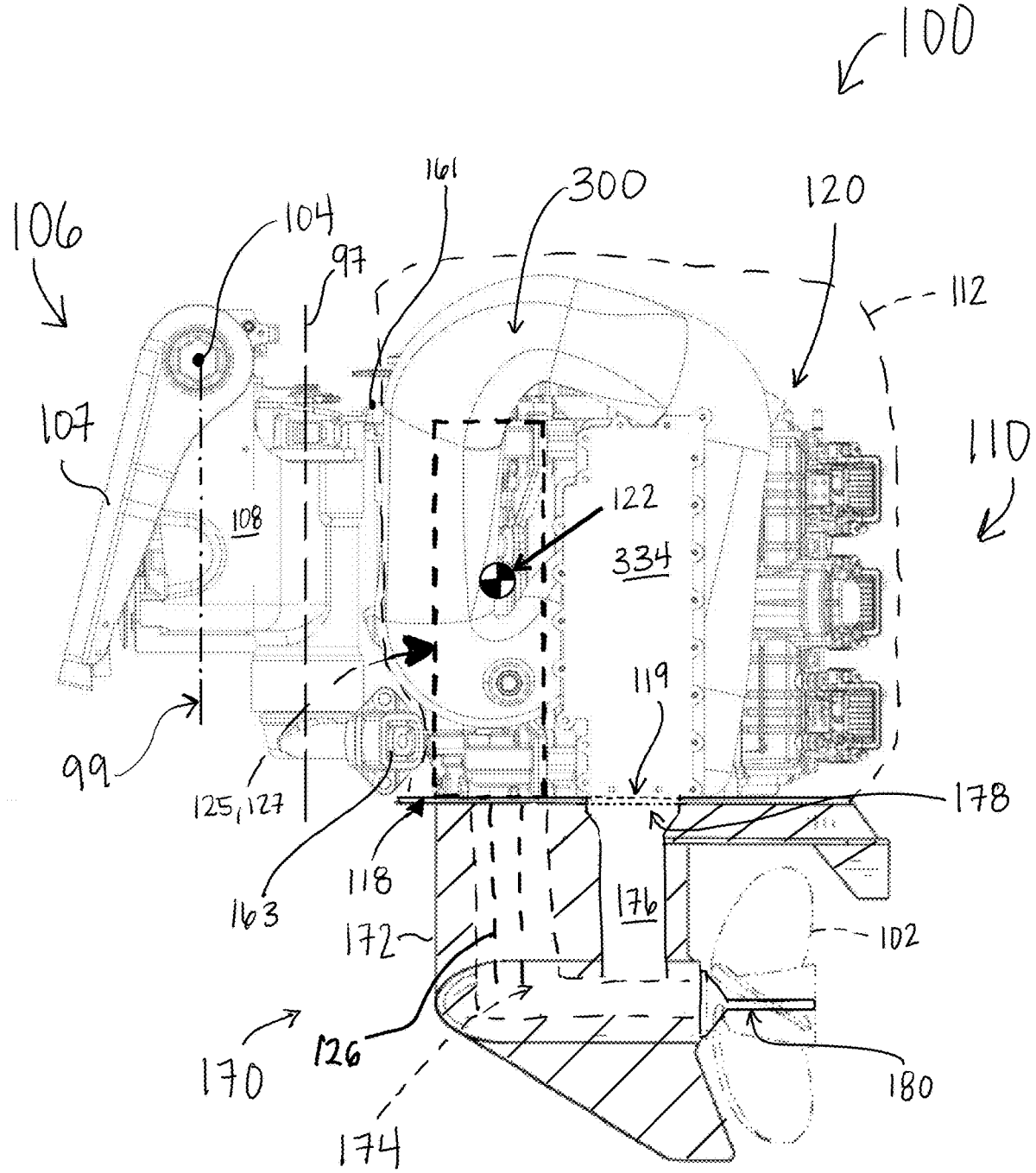
FIG. 3 is a left side elevation view of the marine engine assembly of FIG. 2, with portions of a housing of the marine engine assembly having been removed.

The engine 120 includes a crankshaft 125 disposed in a crankcase 127 (both shown schematically in FIG. 3). The crankshaft 125 drives a driveshaft 126 (schematically shown in FIG. 3) which drives the propeller 102, as is described in more detail below. A center of mass 122 of the engine 120 is disposed about halfway along the vertical height of the crankshaft 125, although the exact position of the center of gravity depends on the details of a particular embodiment of the engine 120.

The engine 120 also includes three air intakes 128 (one intake 128 being shown in FIG. 7) to provide air for combustion in the three engine cylinders (not shown). In some embodiments, the engine 120 could have more or fewer air intakes 128. Air is delivered to the air intakes 128 by an air intake assembly 200, described in more detail below.

The engine 120 also includes an exhaust manifold 123 (FIG. 7) for evacuating exhaust after combustion. Exhaust is channeled away from the exhaust manifold 123 and out of the marine engine assembly 100 by an exhaust conduit 300, described in more detail below.

The engine 120 further includes an upper engine mount 161 and a lower engine mount 163 for connecting the engine 120 to the housing 112.

Figure 6:
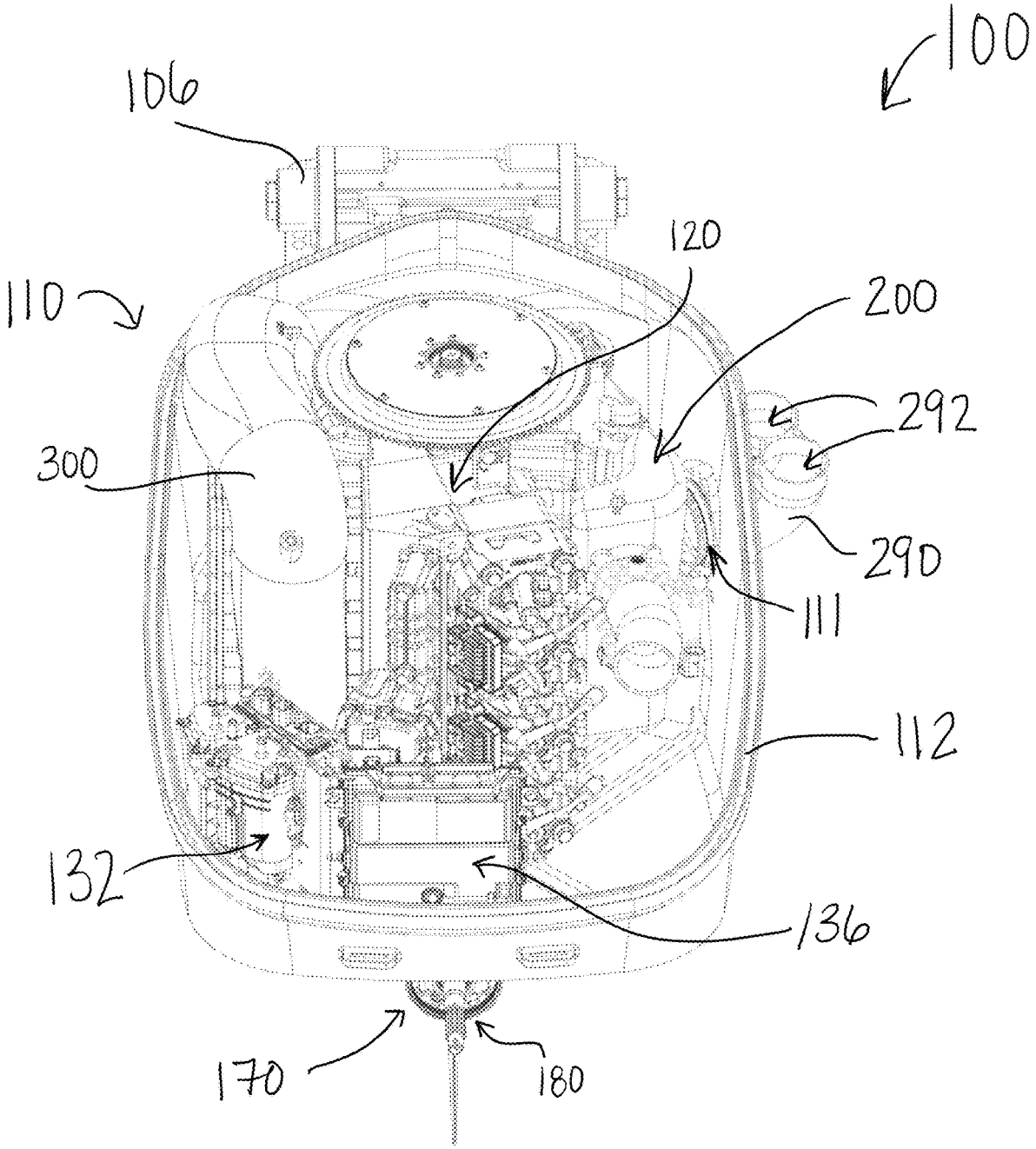
FIG. 6 is a top, rear side perspective view of the marine engine assembly of FIG. 2, with some portions of the marine engine assembly having been removed.
Figure 7:
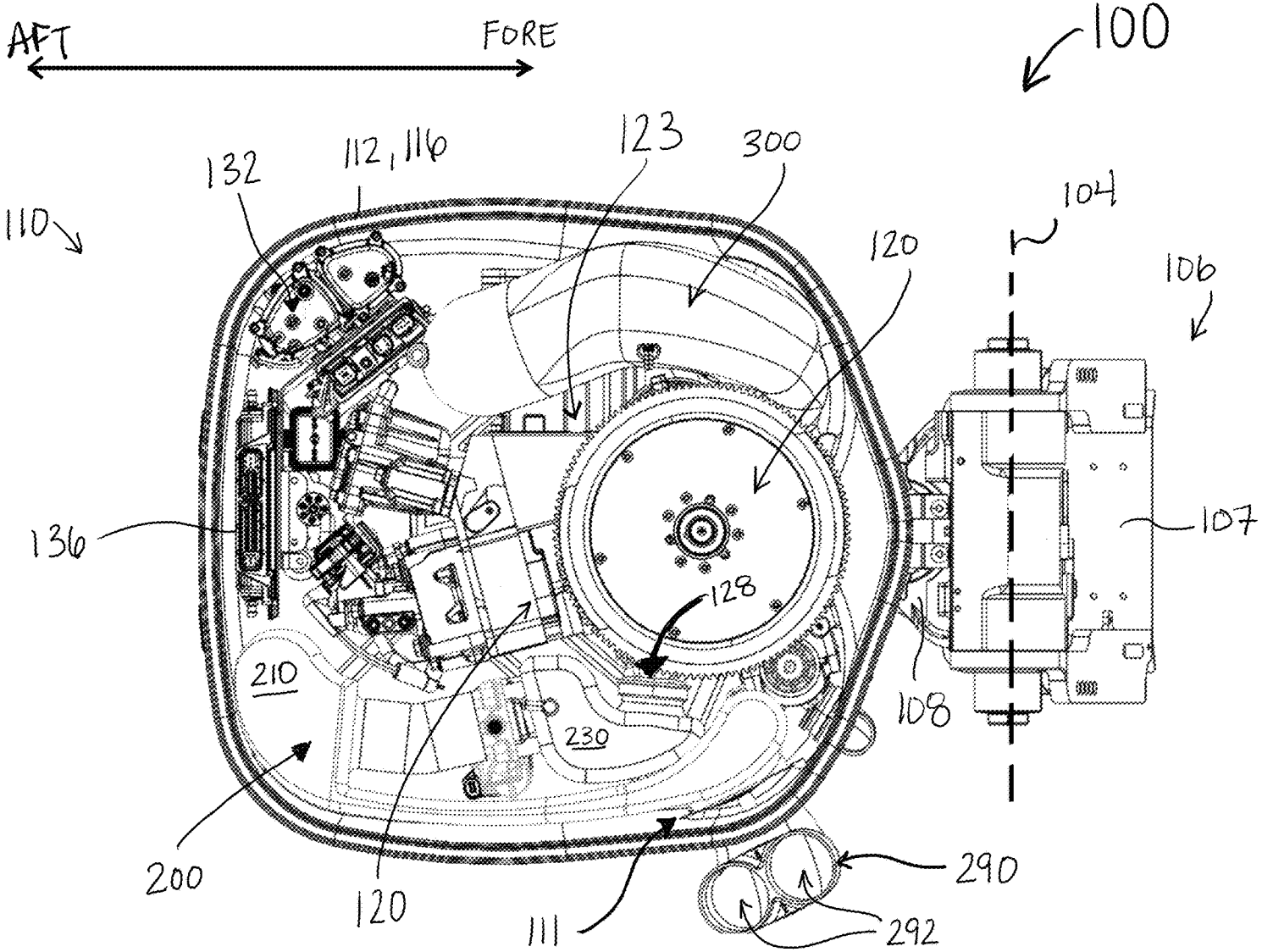
FIG. 7 is a top plan view of the marine engine assembly of FIG. 6.

The engine unit 110 further includes additional components for operating and controlling the engine 120 disposed in the engine unit housing 112. As can be seen in FIGS. 6 and 7, the engine unit 110 includes a fuel vapor separator and fuel pump 132 for providing fuel to the engine 120. The engine unit 110 also includes an engine control unit (ECU) 136 for communicating with and controlling the engine 120.

The marine engine assembly 100 also includes the transom bracket 106, which pivotably connects the engine unit 110 to the watercraft body 12 as noted above. The bracket 106 includes a watercraft portion 107 which is adapted for fastening to the watercraft body 12. The bracket 106 also includes an engine portion 108, connected to the watercraft portion 107, which is fastened to the engine unit housing 112. The engine portion 108 is pivotable with respect to the watercraft portion 107 about a tilt-trim axis 104. The transom bracket 106 thus defines the tilt-trim axis 104 of the marine engine assembly 100, about which the assembly 100 can be trimmed or tilted relative to the watercraft body 12.

Figure 4:
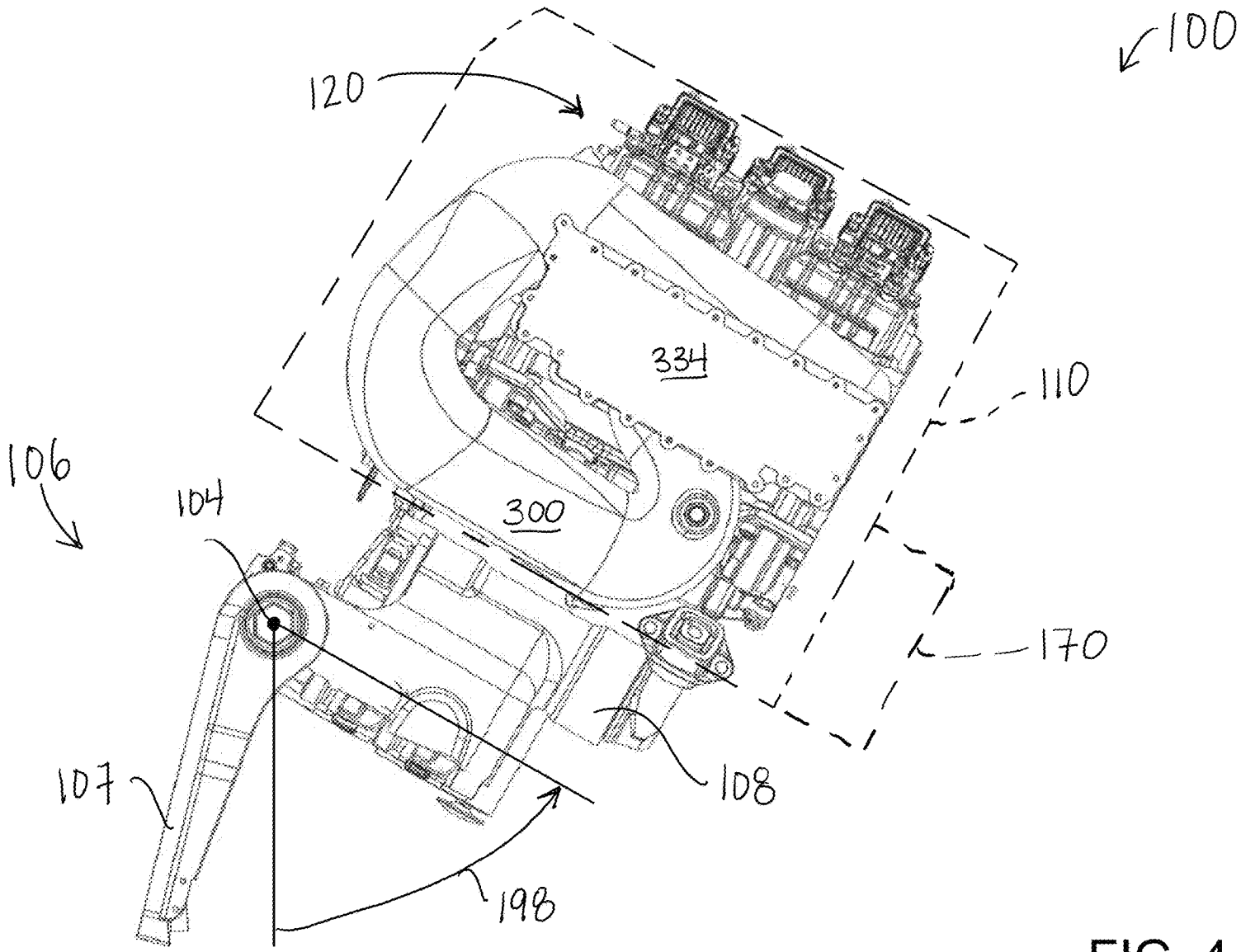
FIG. 4 is a left side elevation view of the marine engine assembly of FIG. 2, shown in a fully tilted up position and with some portions being removed or shown schematically.
Figure 5:
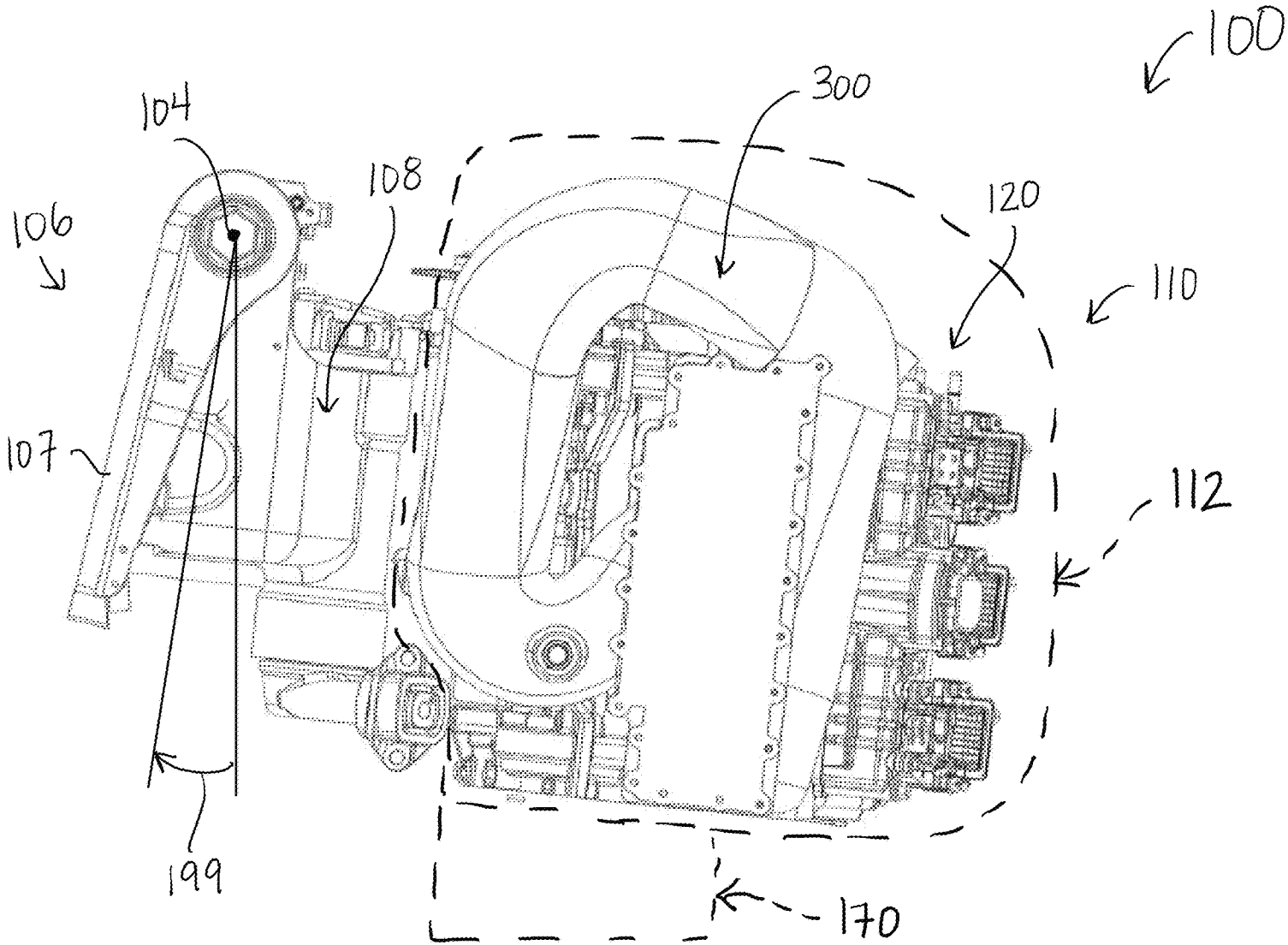
FIG. 5 is a left side elevation view of the marine engine assembly of FIG. 4, shown in a fully trimmed in position.

The marine engine assembly 100 is illustrated in a neutral position in FIG. 3, with the driveshaft 126 arranged vertically, with a vertical line 99 illustrated for reference. In FIG. 4, the marine engine assembly 100 is illustrated at its maximum upward tilt angle 198 of about 65 degrees; the maximum tilt angle 198 could be greater or smaller depending on the embodiment. In FIG. 5, the marine engine assembly 100 is illustrated at its maximum inward trim angle 199 of about −6 degrees. A maximum outward trim angle of about 15 degrees is not illustrated. It is also contemplated that the maximum inward and outward trim angles could be greater or smaller depending on the embodiment. The engine portion 108 of the transom bracket 106 includes an actuator for tilting or trimming the assembly 100 relative to watercraft body 12, although the bracket 106 could be differently arranged in different embodiments.

Figure 2:
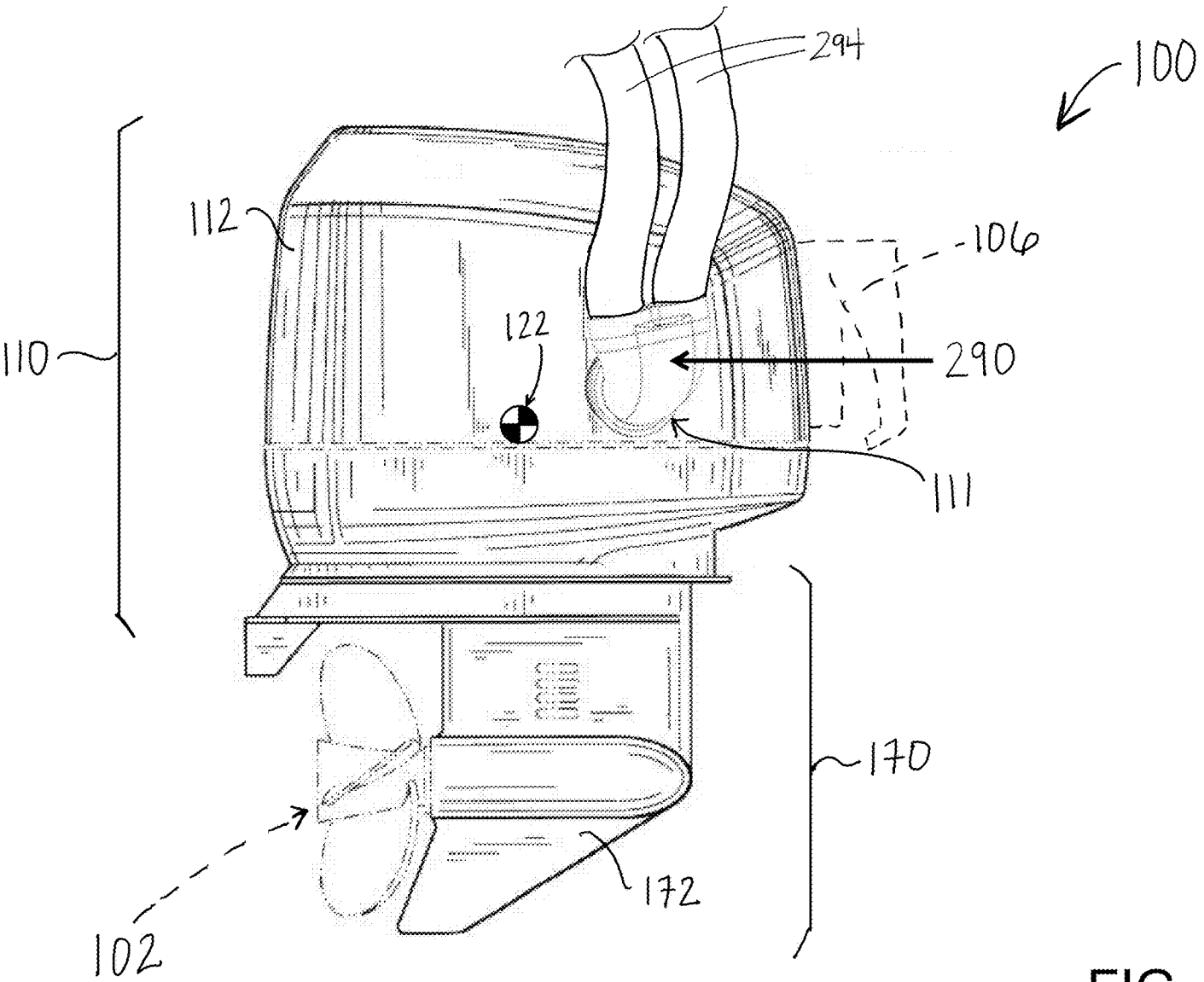
FIG. 2 is a right side elevation view of a marine engine assembly of the watercraft of FIG. 1.

As can be seen in FIGS. 2 and 3, the center of gravity 122 of the engine 120 is disposed below the tilt-trim axis 104, when the assembly 100 is in the neutral position and the driveshaft 126 is vertically oriented. As the assembly 100 is designed to be disposed below the deck 18, the engine 120 and the transom bracket 106 partially vertically overlap, rather than the engine 120 being disposed well above the bracket 106 as would be the case in a conventional outboard engine assembly meant to extend higher relative to the watercraft body 12. In the present embodiment, the center of gravity 122 is vertically between a top end of the transom bracket 106 and a bottom end of the transom bracket 106.

The marine engine assembly 100 also includes a lower unit 170 abutting and connected to the engine unit 110 directly or indirectly. The lower unit 170 includes a lower unit housing 172, which is fastened to the engine unit housing 112.

The lower unit 170 includes a transmission 174 disposed in the housing 172. The transmission 174 is operatively connected to the driveshaft 126. The lower unit 170 also includes a propeller assembly 180 for supporting the propeller 102 and connecting the propeller 102 to the engine 120 for driving the propeller 102. The propeller assembly 180 is operatively connected to the transmission 174 and transfers power from the crankshaft 125 to the propeller 102.

The lower unit housing 172 defines an exhaust passage 176 for receiving exhaust from the engine 120. The top surface of the lower unit housing 172 defines an aperture 178 aligned with and fluidly connected to the exhaust passage 176. The exhaust passage 176 is fluidly connected with channels (not shown) in the propeller assembly 180 which allow exhaust gas to leave the marine engine assembly 100 under water. Expulsion of exhaust via the aperture 178, the exhaust passage 176 and the propeller assembly 180 will be described in more detail below.

With additional reference to FIGS. 8 to 11, the air intake assembly 200 will now be described in more detail.

As can be seen in at least FIG. 7 and as mentioned above, the air intake assembly 200 is disposed in the engine unit housing 112. The air intake assembly 200 forms a conduit between an exterior of the engine unit housing 112 and the engine 120 for providing air for combustion. The air intake assembly 200 is sealed such that surrounding fluids in the engine unit housing 112, such as any air and water present in the engine unit housing 122, are impeded from entering the air intake assembly 200 and thereby will not enter the engine 120 via the air intake assembly 200. Instead, the air intake assembly 200 delivers air from outside the housing 112 to the engine 120 directly, delivering the air needed for combustion in the engine 120. As the engine unit housing 112 is also sealed in order to impede entry of water in which the engine unit housing 112 is immersed, air flow into the engine unit housing 112 is generally not sufficient for proper functioning of the engine 120. The air intake assembly 200 thus supplies the air flow needed into the engine 120 by delivering air from outside of the engine unit housing 112.

The air intake assembly 200 extends generally along the right side of the engine unit housing 112 and is disposed between the engine 120 and the right side of the housing 112. In some embodiments, all or part of the air intake assembly 200 could extend along the left, front, rear, top or other sides of the housing 112, depending on the arrangement of the engine 120 and more specifically the arrangement of the engine air intakes 128. It is also contemplated that all or part of the air intake assembly 200 could extend above the engine 120, depending on the particular embodiment of the engine 120.

The air intake assembly 200 defines an assembly inlet 202 that fluidly communicates with air exterior to the engine unit housing 112 and three outlets 204 fluidly connected to the three cylinder intakes 128 of the engine 120. Depending on the specific embodiment of the engine 120, there could be more or fewer cylinder intakes 128 and the air intake assembly 200 would have a corresponding number of outlets 204.

In the present embodiment, the inlet 202 is fluidly connected to an external conduit 290 (see FIG. 2). The majority of the external conduit 290 is disposed outside of the engine unit housing 112. A portion of the conduit 290 is aligned with and passes through an aperture 111 in the engine unit housing 112. An outlet defined by the external conduit 290 is connected to the inlet 202 through the aperture 111. In some embodiments, the inlet 202 could extend through the aperture 111 and connect to the external conduit 290 outside of the engine unit housing 112. In some other embodiments, the aperture 111 and or connection to the external conduit 290 could be located along an upper portion of the housing 112.

The external conduit 290 includes two inlets 292 (FIGS. 2, 6 and 7) to which hoses 294 are connected (FIG. 2). The hoses 294 are disposed in and supported by the watercraft body 12. The hoses 294 deliver air from above the water line to the air intake assembly 200, via the external conduit 290. In some embodiments, the external conduit 290 could include more or fewer inlets for connecting to hoses disposed in the watercraft body 12. It is also contemplated that a hose extending through the watercraft body 12 could connect directly to the inlet 202 via the aperture 111.

The different components of the air intake assembly 200 will now be described in more detail. The air intake assembly 200 includes a first conduit portion 210, a second conduit portion 230, and a throttle body 250 disposed between the conduit portions 210, 230.

The first conduit portion 210 extends along the length of the right side of the engine unit housing 112. The first conduit portion 210 defines a conduit inlet 212, which is also the assembly intake 202 in the present embodiment. In some embodiments, the inlet 212 could be connected to an additional tube or conduit that defines the assembly inlet 202. The first conduit portion 210 also defines a conduit outlet 214 through which air leaves the first conduit portion 210.

The first conduit portion 210 is structured and arranged to act as a silencer 210 for reducing noise of operation of the marine engine assembly 100. In addition to the illustrated embodiment of the silencer 210, different embodiments could be used in the assembly 100. For example, silencers in some embodiments could be designed according to the technology described in U.S. Pat. No. 5,996,734, published Dec. 7, 1999, the entirety of which is incorporated herein by reference. While the '734 patent relates to two-stroke engines, it should be noted that the same structures could be present in embodiments of the present technology using a four-stroke engine. In some other embodiments, the first conduit portion 210 may not be structured to act as a silencer.

The silencer 210 is formed from three integrally connected portions. There is an inlet portion 216 defining the inlet 212, a resonator portion 220 extending rearward from the inlet portion 216, and an outlet portion 218 extending from the resonator portion 20, opposite the inlet portion 216. It is contemplated that the silencer 210 could be formed from three joined, separate portions.

As is described in the U.S. Pat. No. '734, the shape of the silencer 210, and more specifically the resonator portion 220, is designed to diminish certain vibration frequencies in order to reduce noise of operation of the marine engine assembly 100. In the present embodiment, the resonator portion 220 is structured and arranged to aid in diminishing air vibrations from the engine 120 which may propagate out of the engine 120 and through the air intake assembly 200. As the air intake assembly 200 is fluidly connected with other parts of the watercraft 10 through the hoses 294, sound from the engine 120 entering the air intake assembly 200 could otherwise be channeled up into the watercraft body 12. Inclusion of the resonator portion 220 thus aids in reducing sound from the engine 120 from being sent up into the watercraft 10.

The resonator portion 220 has a length 222 extending from the inlet portion 216 to the outlet portion 218. A width 224 of the resonator portion 220 extends perpendicular to the length 222. While the width 224 varies along the length 222 of the resonator portion 220, the length 222 is greater than the width 224 (at any point along the resonator portion 220). A height 226 of the resonator portion 220 is generally greater than the length 222 and the width 224, although the height 226 does vary along the length 222 of the resonator portion 220. The height 226 extends generally along an entire height of the engine 120, with the increased volume of the height 226 aiding in increasing air flow though the silencer 210. In some embodiments, the height 226 could be greater or smaller than the illustrated embodiment, and may in some cases be smaller than the length 222.

Figure 8:
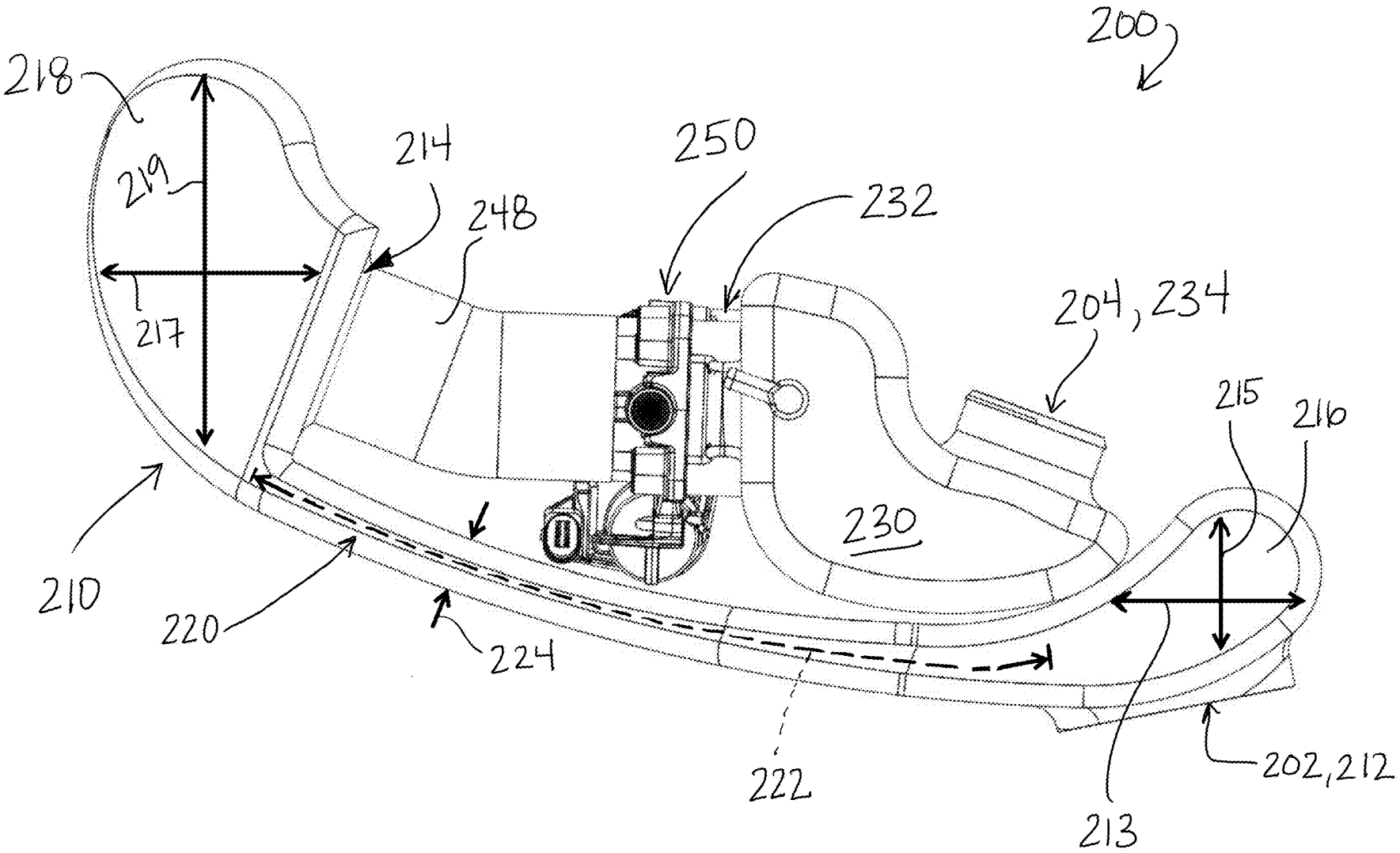
FIG. 8 is a top plan view of an intake assembly of the marine engine assembly of FIG. 2.

As can be seen in FIG. 8, the inlet portion length 213 and the outlet portion length 217 are each less than the length 222 of the resonator portion 220. The inlet portion width 215 and the outlet portion width 219 are each greater than the width 224 of the resonator portion 220. Depending on the particulars of any given embodiment, the exact dimensions of the portions 216, 218, 220 could vary. For example, either one or both of the lengths 213, 217 could be the equal to or greater than the length 222. Similarly, depending on the embodiment and the other corresponding dimensions, the widths 215, 219 could be the equal to or greater than the width 224. The volumes of the inlet and outlet portions 216, 218 generally allow for sufficient air flow for the engine 120, although the relative sizes of the portions 216, 218 could vary in different embodiments.

While the dimensions described herein as "width," "height," and "length" are relative to the orientation of the silencer 220 in the present embodiment of the marine engine assembly 100, it should be noted that functionality of the vibration damping of the silencer 210 depends generally on the ratios between the different dimensions, regardless of their specific orientation. In some embodiments, for example, the silencer 210 could be rotated 90 degrees, such that the "height" is much less than the length, but the "width" is also very large. As can be noted from at least the '734 patent, the resonator portion 222 is formed by having an overall linear length, longitudinally along the resonator portion 222, with at least one dimension perpendicular to the length being much less than the length. The height 226 in this case is large relative to the width 224 in order to facilitate air flow through the silencer 210.

The air intake assembly 200 also includes the second conduit portion 230, also known as a plenum 230, fluidly connected downstream from the silencer 210. The plenum 230 defines an inlet 232 fluidly connected to the silencer 210. The plenum 230 also defines three outlets 234, which are the same as the air intake assembly outlets 204. As is mentioned above, the outlets 204, 234 are connected to the three cylinder intakes 128, and if the engine 120 has more or fewer intakes 128, the plenum 230 would have a corresponding number of outlets 232. In the present embodiment, the cylinder intakes 128 are vertically spaced cylinder intakes 128 and the plenum outlets 234 are similarly vertically spaced. In different embodiments, the intakes 128 and the outlets 234 could be differently arranged.

The air intake assembly 200 also includes the throttle body 250 fluidly connected between the silencer outlet 214 and the plenum inlet 232 for controlling air flow into the engine 120. The air intake assembly 200 further includes a tube 248 connected at an upstream end to the silencer outlet 214 and connected to the throttle body 250 at a downstream end.

Figure 9:
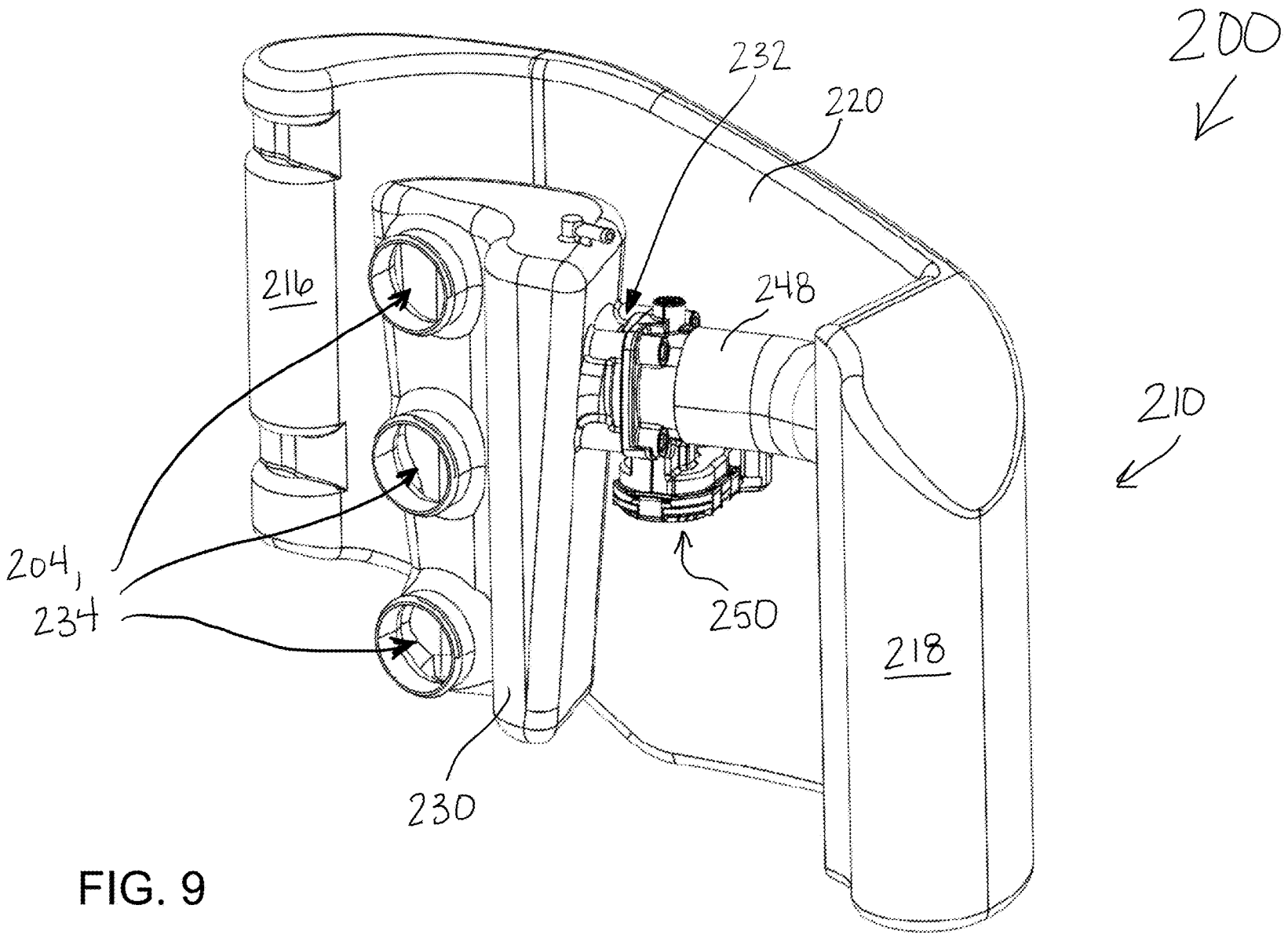
FIG. 9 is a top, rear, left side perspective view of the intake assembly of FIG. 8.
Figure 10:
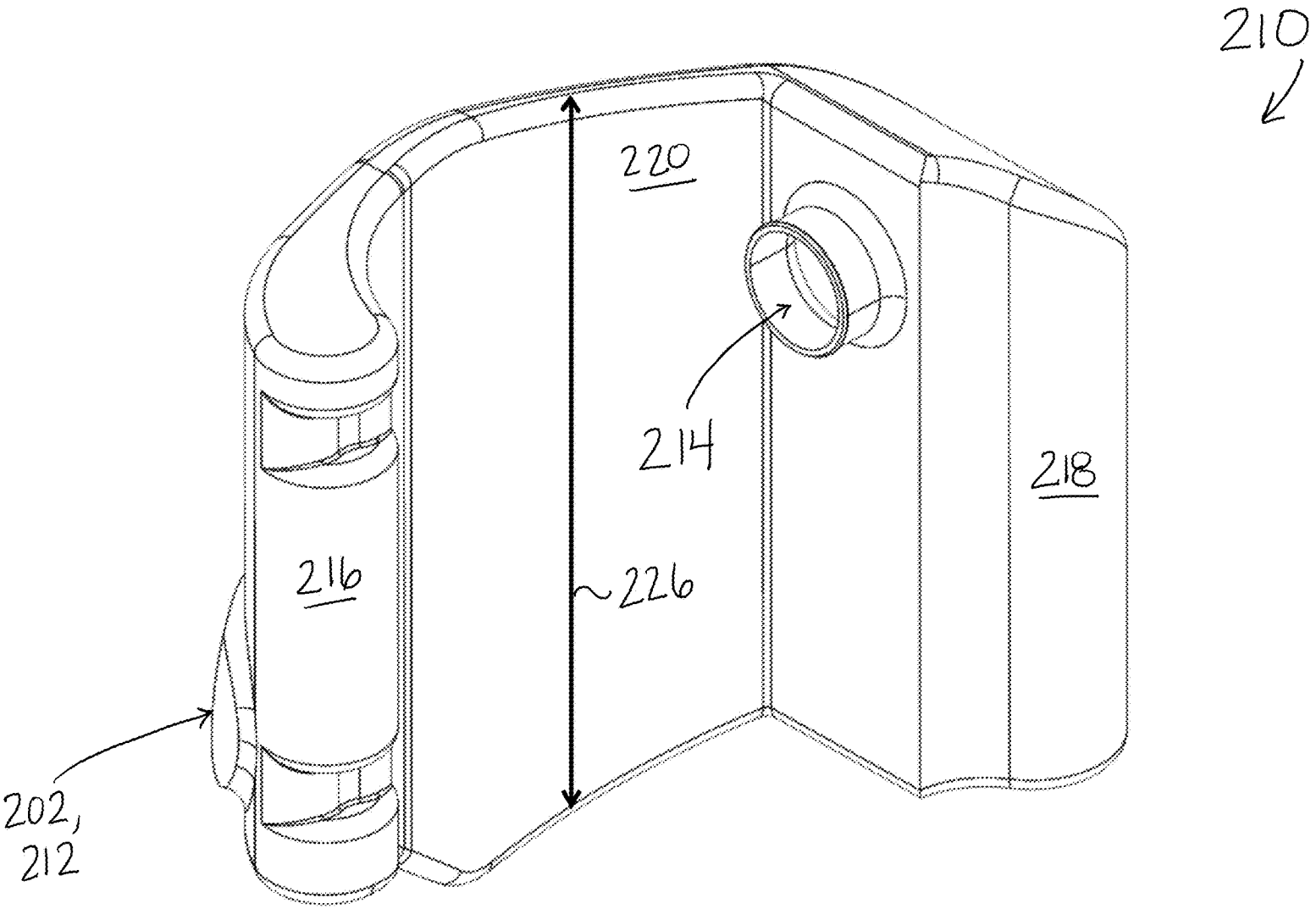
FIG. 10 is a front, left side perspective view of a silencer portion of the air intake assembly of FIG. 8.
Figure 11:
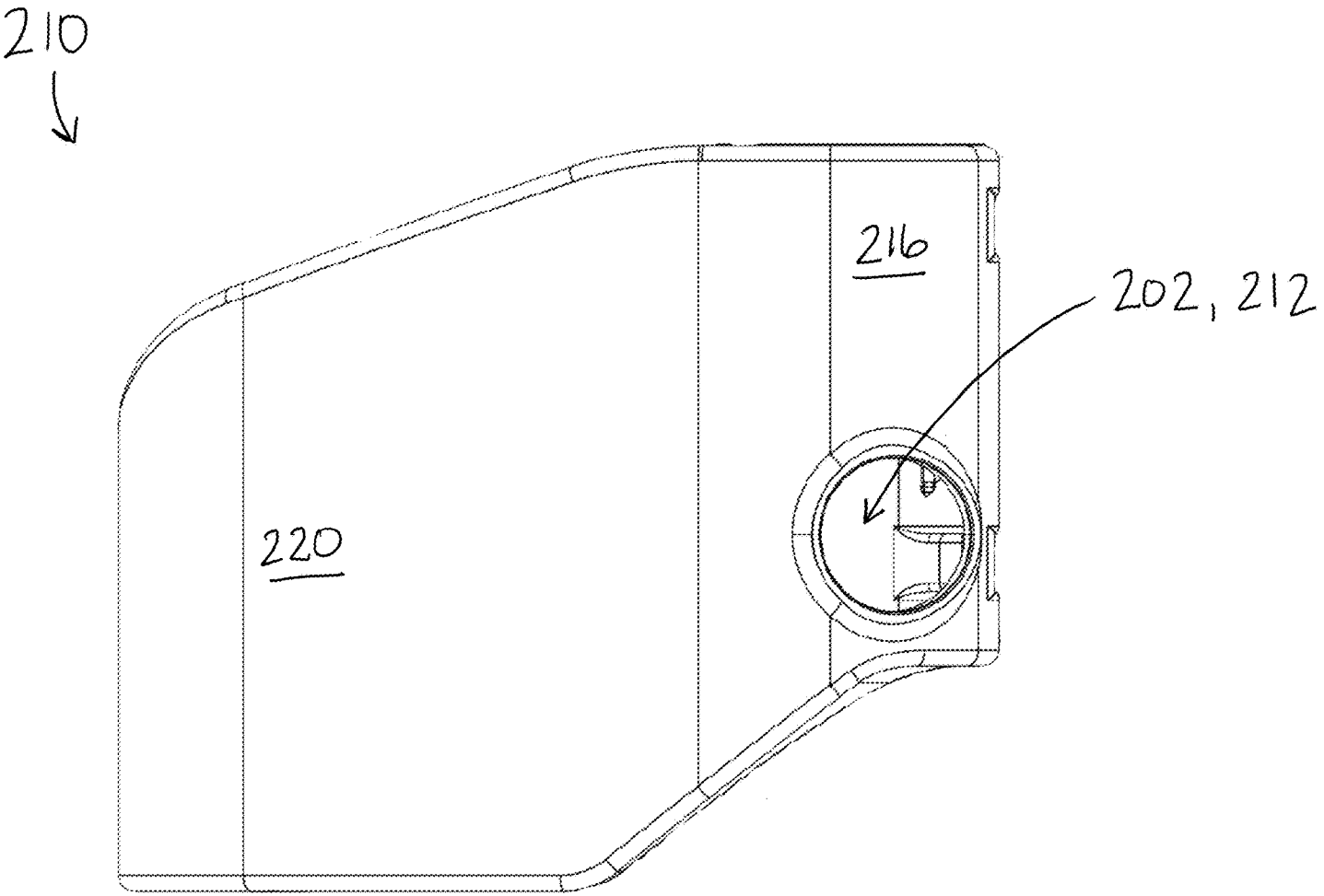
FIG. 11 is a right side elevation view of the silencer portion of FIG. 10.

As can be seen in FIG. 9, the silencer outlet 214, the tube 248, the throttle body 250, and the plenum inlet 232 are all disposed in an upper portion of the air intake assembly 200. With this arrangement, any liquids incidentally entering the silencer 210 will settle in a bottom portion of the silencer 210 and not pass through the tube 248 and the throttle body 250. For example, water spray could in some circumstances enter the hoses 294 in the watercraft body 12, and this arrangement generally prevents this water from reaching the engine 120. In some embodiments, it is contemplated that the silencer outlet 214, the tube 248, the throttle body 250, and the plenum inlet 232 could have different relative arrangements. In some embodiments, it is contemplated that the tube 248 could be omitted and the throttle body 250 be connected directly to the silencer 210.

The air intake assembly 200 could include additional components in some embodiments. It is also contemplated that in different embodiments, the specific shapes and dimensions of the components of the air intake assembly 200 could vary from those illustrated.

With additional reference to FIGS. 12 and 13, the exhaust conduit 300 will now be described in more detail.

The exhaust conduit 300 is disposed in the engine unit housing 112, extending along the left lateral side of the engine unit housing 112. Specifically, the exhaust conduit 300 is disposed on the left side of the engine 120 between the engine 120 and the housing 112, generally opposite the air intake assembly 200. In some embodiments, the exhaust conduit 300 could be differently arranged or located.

The exhaust conduit 300 includes a conduit body 302. The conduit body 302 is formed from several metal cast portions, but it is contemplated that the conduit body 302 could be differently produced. In some embodiments, for example, the conduit body 302 could be produced as one integral piece by additive manufacturing. In different embodiments, the conduit body 302 could be made from ceramic materials, different metals, and/or other materials.

The exhaust conduit 300 is fluidly connected to the engine 120 and more specifically to the exhaust manifold 123. An exhaust inlet 320 defined by the conduit body 302 is fluidly connected to and receives exhaust from the exhaust manifold 123. As the engine 120 is a two-stroke engine 120, the exhaust conduit 300 is also structured and arranged to function as an expansion chamber (also referred to as a tuned pipe or tune pipe) for the engine 120. In embodiments where the engine 120 is a four-stroke engine, it is contemplated that the exhaust conduit 300 could be differently arranged (as it would not need an expansion chamber). For example, the overall length that the exhaust passes through in the exhaust conduit 300 could be reduced in some embodiments.

Exhaust entering through the exhaust inlet 320 passes through the conduit body 302, subsequently exiting the conduit body 302 through an exhaust outlet 340 defined therein. The exhaust outlet 340 is disposed below and generally laterally aligned with the exhaust inlet 320.

The conduit body 302 includes a central portion 330 in which both the exhaust inlet 320 and the exhaust outlet 340 are defined. The exhaust inlet 320 and the exhaust outlet 340 are both defined in the same side of the central portion 330, specifically the right side of the central portion 330. It is contemplated that the exhaust inlet 320 and the exhaust outlet 340 could be defined in different sides of the exhaust conduit 300.

Figure 12:
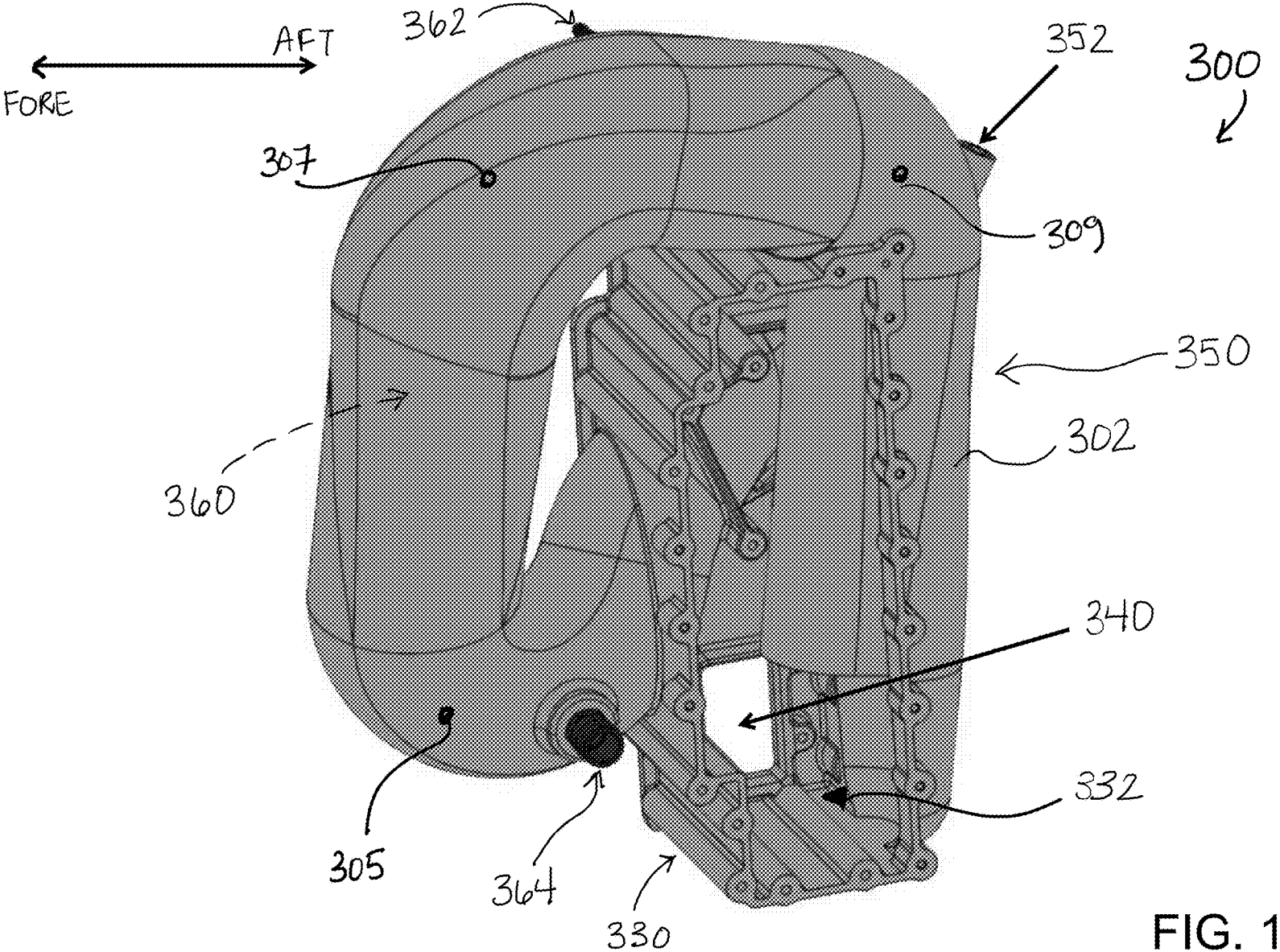
FIG. 12 is a front, left side perspective view of an exhaust conduit of the marine engine assembly of FIG. 2.
Figure 13:
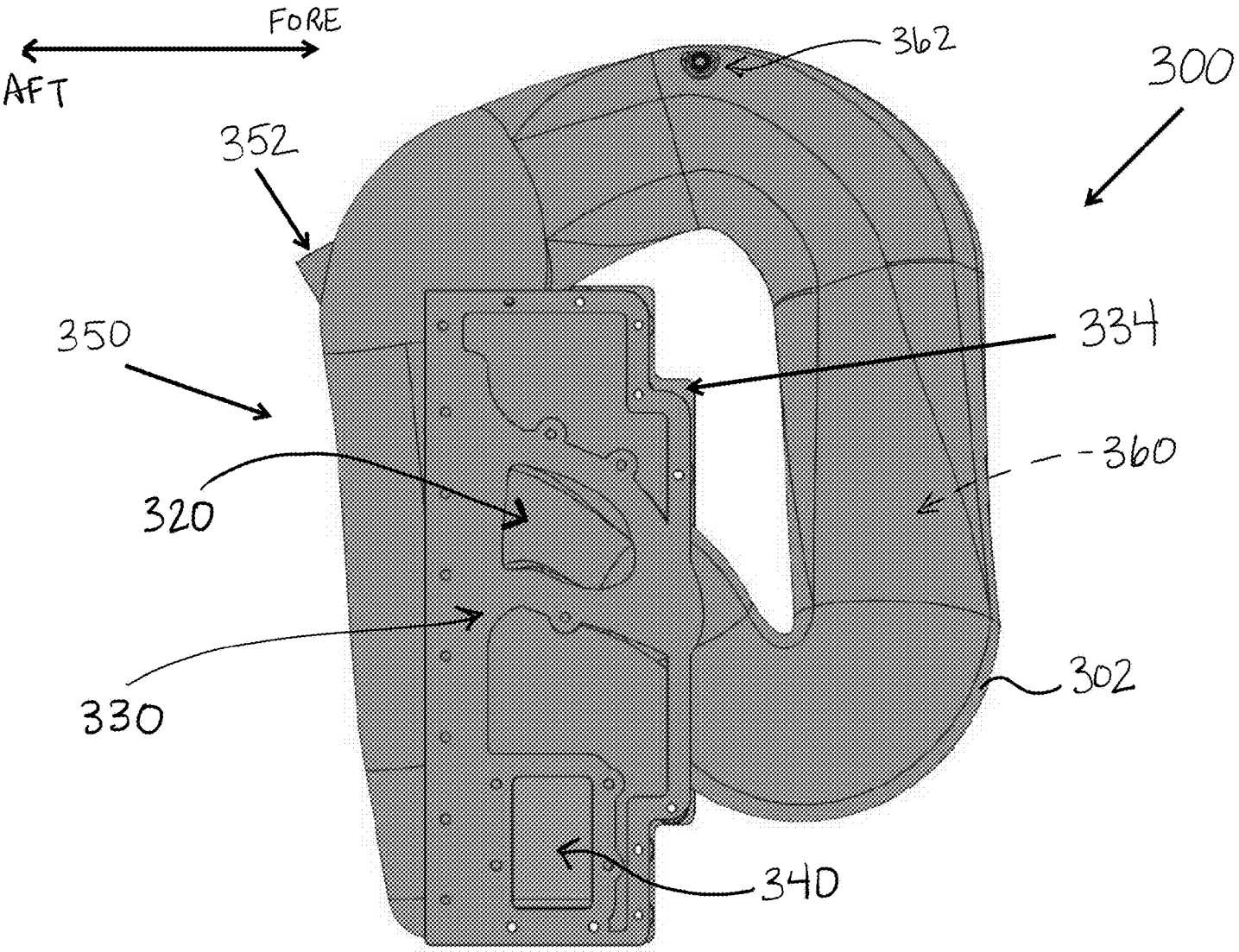
FIG. 13 is a right side elevation view of the exhaust conduit of FIG. 12.

The central portion 330 forms a chamber 332, as is illustrated in FIG. 12. The exhaust conduit 300 includes a plate 334 fastened to the conduit body 302. The plate 334 selectively closes the chamber 332, as can be seen in FIG. 3. In some embodiments, the conduit body 302 could be formed as one closed conduit such that the plate 334 would no longer be necessary. In other embodiments, the side of the chamber 332 currently formed by the plate 334 could be integrally formed, and the side of the chamber 332 defining the inlet 320 and the outlet 340 could be a selectively connectable plate.

The exhaust outlet 340 is fluidly connected to a bottom side 118 of the engine unit housing 112 via a channel formed by the engine 120 below the exhaust manifold 123. The bottom side 118 defines an aperture 119 therein, the pipe fluidly communicating with the aperture 119 such that exhaust flowing out of the exhaust outlet 340 is delivered to the aperture 119.

As can be seen in at least FIG. 3, the aperture 119 in the engine unit housing 112 is aligned with the aperture 178 of the lower unit housing 172. The exhaust outlet 340 of the exhaust conduit 300 is thus fluidly connected to the exhaust passage 176 of the lower unit 170, via the flexible pipe and the apertures 119, 178. Exhaust gas collected by the exhaust conduit 300 from the exhaust manifold 123 is delivered to the exhaust passage 176, where it will then exit the marine engine assembly 100 through the propeller assembly 180, as is mentioned above.

Returning to FIGS. 12 and 13, a portion 350 of the exhaust conduit 300 is disposed rearward of the exhaust inlet 320. This portion 350 defines a water inlet 352 which is arranged to allow water to pass through the portion 350 of the exhaust conduit 300 disposed rearward of the exhaust inlet 320, downstream from the inlet 320. The water then flows out of the exhaust conduit 300 via the exhaust outlet 340. The water flowing through the exhaust conduit 300 aids in cooling the conduit body 302.

A forward portion of the conduit body 302 also includes a water jacket 360 to aid in cooling the forward portion of the exhaust conduit 300. The water jacket 360, surrounding the passage through which exhaust flows, includes a water inlet 364 in a bottom portion of the conduit body 302. Water enters through the inlet 364, flows upward through the water jacket 360, and then exits the water jacket 360 through an outlet 362. It should be noted that unlike the water inlet 352, water passing through the water jacket 360 does not mix with the exhaust gases.

The overall form of the exhaust conduit 300 will now be described in more detail. While the specific form of the present embodiment will now be described, this is simply one non-limiting shape possible for the exhaust conduit 300. Overall, the exhaust conduit 300 is structured and arranged such that water entering the exhaust passage 176 via the propeller assembly 180 cannot reach the exhaust outlet of the engine 120, regardless of the tilt or trim angle of the marine engine assembly 100.

The exhaust conduit 300 extends forward and downward from the exhaust inlet 320. From a lower, forward part (represented by point 305 of FIG. 12), the exhaust conduit 300 then extends generally upward toward point 307. The front portion of the exhaust conduit 300 extends along an inside surface of the front side of the engine unit housing 112. The front portion of the exhaust conduit 300 extends forward of the crankcase 127 of the engine 120.

From an upper, forward part (represented by point 307), the exhaust conduit 300 extends rearward. This portion of the exhaust conduit 300 extends above the center of mass 122 of the engine 120, although more or less of the conduit 300 could be above the center of mass 122. From an upper, rearward part (represented by point 309), the exhaust conduit 300 extends downward, rearward of the exhaust inlet 320, and slightly forward toward the exhaust outlet 340. The exhaust conduit 300 thus generally wraps around the exhaust inlet 320 such that the exhaust outlet 340 is located proximate the inlet 320, even though the exhaust passes along a much longer path. The exhaust conduit 300 extends towards the highest, forwardmost point inside the engine unit housing 112 and as close to the tilt-trim axis as possible. It will be appreciated that the closer the exhaust conduit 300 is to the tilt-trim axis, the higher it will remain when the marine engine assembly 100 is in the fully trimmed in position. As such, an exhaust conduit 300 as described above helps prevent water from reaching the engine 210 via the exhaust manifold 123.

Modifications and improvements to the above-described embodiments of the present technology may become apparent to those skilled in the art. The foregoing description is intended to be exemplary rather than limiting.

What is claimed is:

1. A marine engine assembly for mounting to a watercraft, the marine engine assembly comprising:
- an engine unit including:
  - an engine unit housing being sealed such that water in which the engine unit housing is immersed is impeded from entering the engine unit housing;
  - an engine disposed in the engine unit housing; and
  - an air intake assembly disposed in the engine unit housing, the air intake assembly forming a conduit between an exterior of the engine unit housing and the engine,
  - the air intake assembly defining an inlet fluidly communicating with air exterior to the engine unit housing, the engine unit housing defining at least one aperture aligned with the inlet,
  - the air intake assembly defining at least one outlet fluidly connected with at least one cylinder intake of the engine,
  - the air intake assembly being sealed such that fluids surrounding the air intake assembly within the engine unit housing are impeded from entering the air intake assembly; and
- a propulsion device operatively connected to the engine.

2. The marine engine assembly of claim 1, wherein the air intake assembly includes at least one throttle body disposed between the inlet and the at least one outlet.

3. The marine engine assembly of claim 1, further comprising:
- a lower unit abutting and connected to the engine unit, the lower unit including:
  - a lower unit housing fastened to the engine unit housing;
  - a gear case disposed in the lower unit housing, the gear case being operatively connected to the engine; and
  - the propulsion device connected to the gear case.

4. The marine engine assembly of claim 1, wherein the air intake assembly includes:
- a first conduit portion defining a first conduit inlet and a first conduit outlet;
- a second conduit portion defining:
  - a second conduit inlet fluidly connected to the first conduit outlet; and
  - at least one second conduit outlet defined by the second conduit portion, the at least one second conduit outlet being fluidly connected to the at last one cylinder intake of the engine; and
- a throttle body fluidly connected between the first conduit outlet and the second conduit inlet.

5. The marine engine assembly of claim 4, wherein the first conduit inlet is the inlet of the air intake assembly.

6. The marine engine assembly of claim 4, wherein the air intake assembly further includes a hose extending and connected between the first conduit outlet and the throttle body.

7. The marine engine assembly of claim 4, wherein the first conduit portion is a silencer for reducing noise of operation.

8. The marine engine assembly of claim 4, wherein the second conduit portion is a plenum.

9. The marine engine assembly of claim 4, wherein the first conduit outlet, the throttle body, and the second conduit inlet are disposed in an upper portion of the air intake assembly.

10. The marine engine assembly of claim 4, wherein:

the at least one cylinder intake is three vertically spaced cylinder intakes;

the at least one the second conduit outlet is three vertically spaced second conduit outlets; and each of the three second conduit outlets is fluidly connected to a corresponding one of the three cylinder intakes.

11. The marine engine assembly of claim 1, wherein:

the air intake assembly includes a silencer; and the silencer includes:

an inlet portion defining the inlet, a resonator portion extending from the inlet portion, the resonator portion being adapted for reducing noise of operation, and a outlet portion extending from the resonator portion.

12. The marine engine assembly of claim 11, wherein:

the resonator portion has a length extending from the inlet portion to the outlet portion and a width extending perpendicular to the length, the length being greater than the width.

13. The marine engine assembly of claim 12, wherein:

the inlet portion has a first length and a first width;

the length of the resonator portion is a second length and the width of the resonator is a second width;

the outlet portion has a third length and a third width;

the second length is greater than the first length and the third length; and the second width is less than the first width and the third width.

14. The marine engine assembly of claim 13, wherein a height of the resonator portion is greater than the second length and the second width.

15. The marine engine assembly of claim 1, wherein:

the air intake assembly extends along one lateral side of the engine unit housing; and the air intake assembly is disposed between the engine and the one lateral side of the engine unit housing.

16. The marine engine assembly of claim 1, further comprising:

an exhaust conduit fluidly connected to the engine, the exhaust conduit being disposed in the engine unit housing; and wherein:

the air intake assembly and the exhaust conduit are disposed on opposite sides of the engine.

17. The marine engine assembly of claim 1, further comprising an external conduit fluidly connected to the air intake assembly, at least a majority of the external conduit being disposed outside of the engine unit housing, at least a portion of the external conduit being aligned with the at least one aperture of the engine unit housing, an outlet defined by the external conduit being fluidly connected to the inlet of the air intake assembly.

18. The marine engine assembly of claim 1, further comprising a transom bracket connected to the engine unit housing.

19. The marine engine assembly of claim 1, further comprising a driveshaft operatively connecting the engine to the propulsion device; and wherein:

the transom bracket defines a tilt-trim axis; and a center of mass of the engine is disposed below the tilt-trim axis at least when the driveshaft is vertically oriented.

20. A watercraft comprising:

a watercraft body; and a marine engine assembly mounted to the watercraft body, the marine engine assembly comprising:

a transom bracket connected to the watercraft body, the transom bracket defining a tilt-trim axis;

an engine unit including:

an engine unit housing connected to the transom bracket;

an engine disposed in the engine unit housing; and an air intake assembly disposed in the engine unit housing, the air intake assembly forming a conduit between an exterior of the engine unit housing and the engine, the air intake assembly defining an inlet fluidly communicating with air exterior to the engine unit housing, the engine unit housing defining at least one aperture aligned with the inlet, the air intake assembly defining an outlet fluidly connected with at least one cylinder intake of the engine, the air intake assembly being sealed such that fluids surrounding the air intake assembly within the engine unit housing are impeded from entering the air intake assembly;

a driveshaft operatively connected to the engine, a center of mass of the engine being disposed below the tilt-trim axis at least when the driveshaft is vertically oriented; and a propulsion device operatively connected to the driveshaft.

* * * * *